US005603247A

United States Patent [19]

Wei

[11] Patent Number: 5,603,247

[45] Date of Patent: Feb. 18, 1997

[54] RATCHET WRENCH

[76] Inventor: Hung-Yin Wei, No. 21, Lane 225, Tai-Ping Road, Tai-Ping Hsiang, Taichung Hsien, Taiwan

[21] Appl. No.: 540,020

[22] Filed: Oct. 6, 1995

[51] Int. Cl.[6] ..... B25B 13/46

[52] U.S. Cl. ..... 81/63.2; 81/63

[58] Field of Search ..... 81/63, 63.2, 60, 81/61, 62, 63.1; 76/114

[56] References Cited

U.S. PATENT DOCUMENTS

| | | | |
|---|---|---|---|
| 1,127,717 | 2/1915 | Ash | 81/62 |
| 4,748,875 | 6/1988 | Lang | 81/63 |
| 5,119,701 | 6/1992 | Wei | 81/63 |
| 5,199,332 | 4/1993 | Batten | 81/63.2 |
| 5,325,744 | 7/1994 | Horikawa | 81/63.2 |

FOREIGN PATENT DOCUMENTS

| | | | |
|---|---|---|---|
| 3406063 | 8/1985 | Germany | 81/60 |
| 53573 | 2/1990 | Japan | 81/63.2 |

*Primary Examiner*—D. S. Meislin
*Assistant Examiner*—Joni B. Danganan
*Attorney, Agent, or Firm*—Morton J. Rosenberg; David I. Klein

[57] ABSTRACT

An improved ratchet wrench includes an upper plate, a lower plate, a base disposed between the upper plate and the lower plate, two ratchets, two trigger blocks, two springs and two baffle elements. Both the upper plate and the lower plate have at least a bent portion at one end thereof. The distance between a middle portion of the upper plate and a middle portion of the lower plate is smaller than the distance between an upper bent portion and a lower bent portion of the plates, such that the distance between the middle portions is equivalent to the distance between the bent portions of the upper and lower plates multiplied by a cosine of the angle of the bend. By such an arrangement, the upper plate and the lower plate are identical in shape and length, and hence manufacture of the ratchet wrench may be speeded up and costs reduced.

1 Claim, 5 Drawing Sheets

RATCHET WRENCH

BACKGROUND OF THE INVENTION

1. Field of the Invention

The present invention relates generally to a ratchet wrench, and more particularly to a ratchet wrench which is simple in construction and which is faster and less costly to manufacture.

2. Description of the Prior Art

FIGS. 1 and 2 show a conventional bi-directional ratchet wrench, which mainly comprises two flat plates 11, 12, a base 13, a ratchet disposed between the plates 11, 12, a trigger block 15, a spring 16 disposed between the trigger block 15 and the base 13, and a steel ball 17. Rivets 18 are used to assemble the structural elements. The distance between the plates 11 and 12 is the same through-out.

With reference to FIG. 3, which shows another prior bi-directional ratchet wrench intended as an improvement on the above-described ratchet wrench. The ratchet wrench in FIG. 3 comprises an upper plate 41 and a lower plate 42. Each of the plates has two ends which bend in opposite directions, forming a first bent portion and a second bent portion. However, like the prior wrench illustrated in FIGS. 1 and 2, it is also necessary to maintain a uniform distance between the two plates 41 and 42. In other words, the distance between the plates 41 and 42 at the handle portion is equivalent to that between the bent portions of the respective plates 41 and 42. By this arrangement, after a base 43 is secured between the upper plate 41 and the lower plate 42 at the handle portion by rivets, the ratchets 44 pivotally provided at either ends of the base 43 may rotate within their corresponding clearances. Therefore, in order to assemble the wrench as shown in FIG. 3, it is necessary to extend a second upper bent portion 41B of the upper plate 41 so that a ratchet 44 may be pivotally provided between the second bent portion 41B and a second lower bent portion 42B of the lower plate 42, and similarly, a first upper bent portion-41A of the upper plate 41 has to be extended so that another ratchet 44 may be pivotally provided between the first upper bent portion 41A of the upper plate 41 and a first lower bent portion 42A of the lower plate 42. In order to join the two plates 41 and 42 smoothly, a length M of the first upper bent portion 41A of the upper plate 41 has to be different from a length N of the first second bent portion 42A of the lower plate 42, while a length 0 of the second upper bent portion 41B of the upper plate 41 has to be different from a length P of the second lower bent portion 42*b* of the lower plate 42. A ratchet wrench of such a construction requires that the plates 41 and 42 have the same overall length while the length of the bent portions of the upper plate 41 is different from that of the bent portions of the lower plate 42. Manufacture of such prior wrenches is therefore not only costly but also slow.

FIG. 4 shows another kind of ratchet wrench which consists of an upper plate and a lower plate, and a base disposed between the two plates. The base integrally extends to form a protective flange 5 to provide a better outlook. In this prior art, the length of the bent portions of the upper plate must also be configured to be different from that of the bent portions of the lower plate.

SUMMARY OF THE INVENTION

A primary object of the present invention is to provide an improved ratchet wrench comprising of an upper plate and a lower which are identical ill length and shape with a distance between middle straight portions of the upper and lower plates different from that between bent portions of the upper plate and those of the lower plates, thereby eliminating the drawbacks in the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 5:
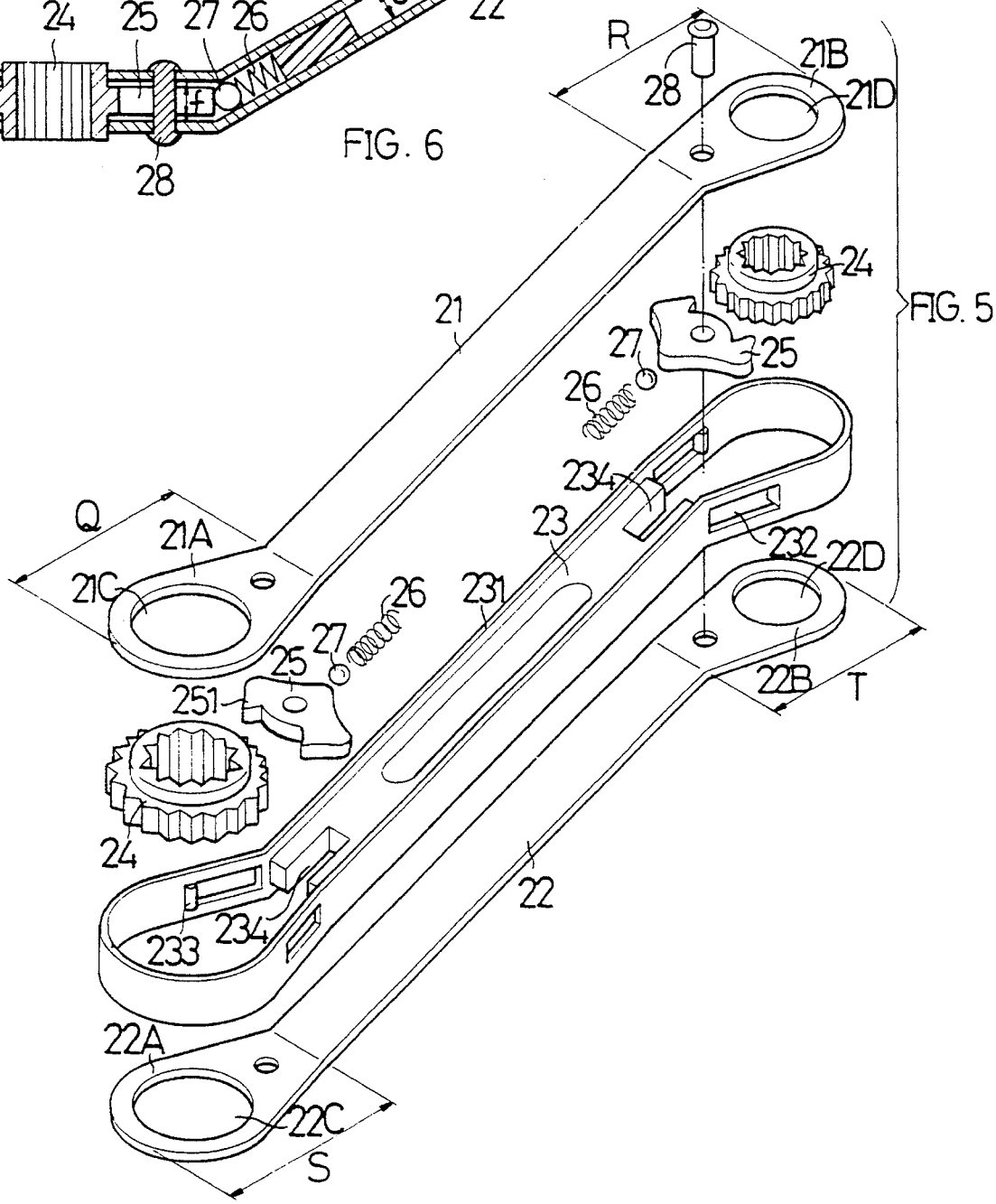
FIG. 5 is a perspective view of a first preferred embodiment of the improved ratchet wrench of the present invention.

With reference to FIG. 5, a first preferred embodiment of the improved ratchet wrench according to the present invention comprises an upper plate 21, a lower plate 22, a base 23, two ratchets 24, two trigger blocks 25, two springs 26 and two baffle elements 27.

The upper plate 21 has a first upper bent portion 21A and a second upper bent portion 21B at both ends thereof. Both bent portions 21A, 21B bend in opposite directions. Similarly, the lower plate 22 also has a first lower bent portion 22A and a second lower bent portion 22B at both ends thereof and which bend in opposite directions. The first bent upper portion 21A has a length Q equivalent to a length S of the first lower bent portion 22A, and the second upper bent portion 21B has a length R equivalent to a length T of the second lower bent portion 22B. These bent portions, 21A, 21B, 22A, 22B, respectively have circular holes 21C, 21D, 22C, 22D.

The base 23 is disposed between the upper plate 21 and the lower plate 22. The base 23 has a front end and a rear end, and a protective flange 231 extending from both lateral sides of the base 23 for enclosing the peripheries of the upper plate 21 and the lower plate 22. The peripheries of the upper plate 21 and the lower plate 22 just flush with the inner side surface of the protective flange 231 of the base 23. The protective flange 231 is provided with two openings 232 near either end thereof for receiving the two trigger blocks 25. Two positioning bosses 233 are respectively provided at either inner side of the protective flange 231 near its either end at a location for receiving bent portions of the two plates 21 and 22.

An elongated slot 234 is further provided in either end of the base 23 for accommodating therein the spring 26. The spring 26 urges against the baffle element 27, which in turn urges against a rear end of the trigger block 25, causing teeth 251 at a front portion of the trigger block 25 to engage with the ratchet 24 pivotally disposed between the bent portions of the two plates 21 and 22.

Figure 1:
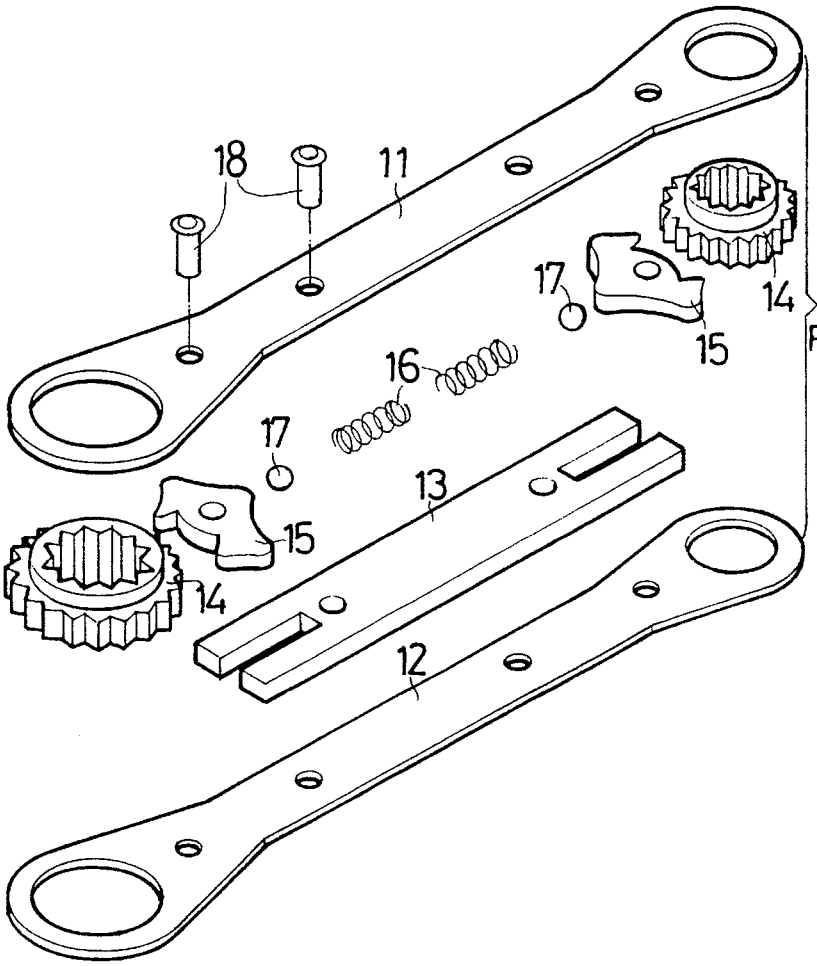
FIG. 1 PRIOR ART
FIG. 1 is a perspective exploded view of a conventional flat plate type ratchet wrench.
Figure 2:
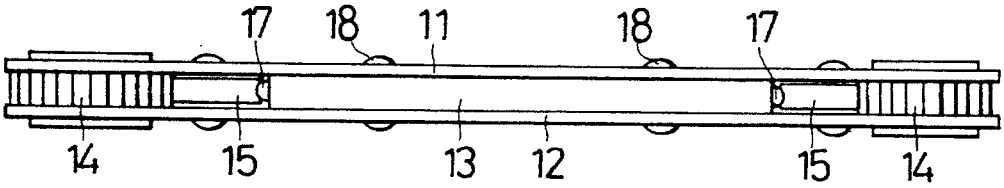
FIG. 2 PRIOR ART
FIG. 2 is a side view of the conventional ratchet wrench of FIG. 1.
Figure 3:
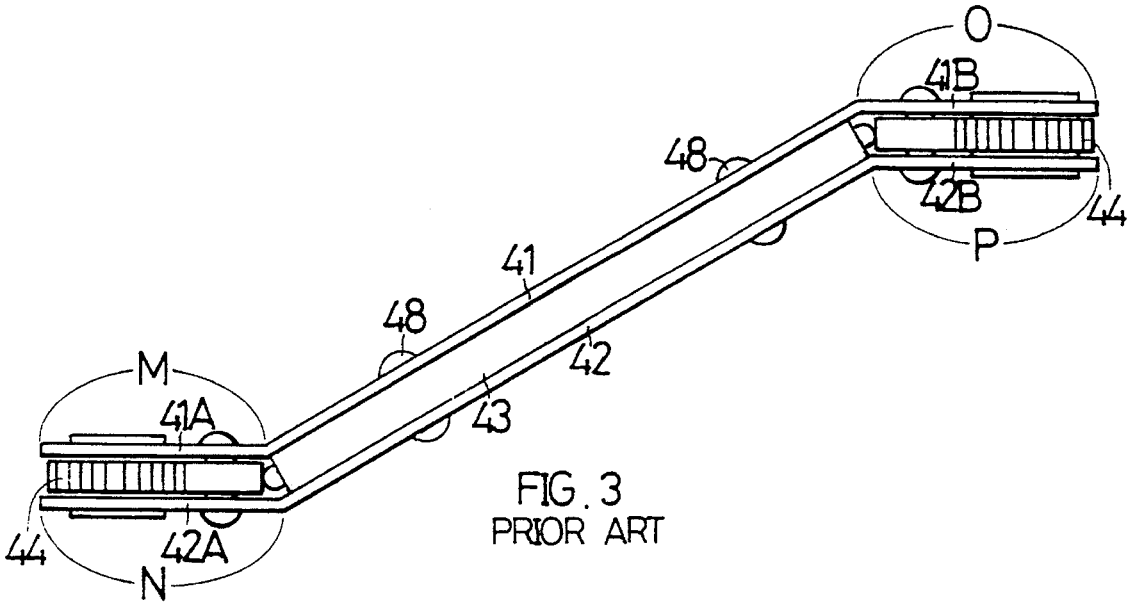
FIG. 3 PRIOR ART
FIG. 3 is a side view of a conventional ratchet wrench with bent portions.
Figure 4:
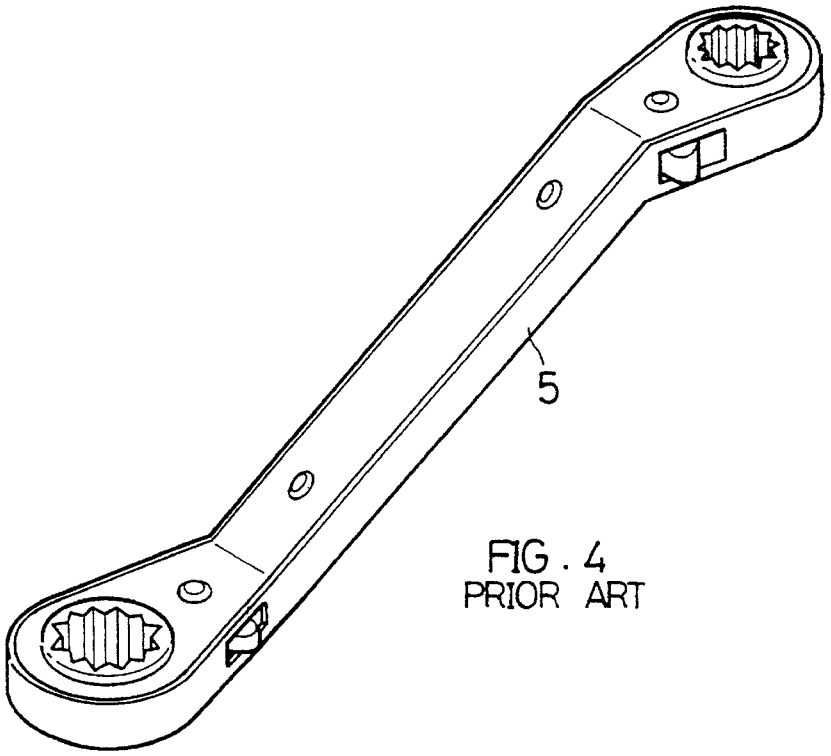
FIG. 4 PRIOR ART
FIG. 4 is a perspective view of a conventional ratchet wrench with a protective flange and bent portions.
Figure 6:
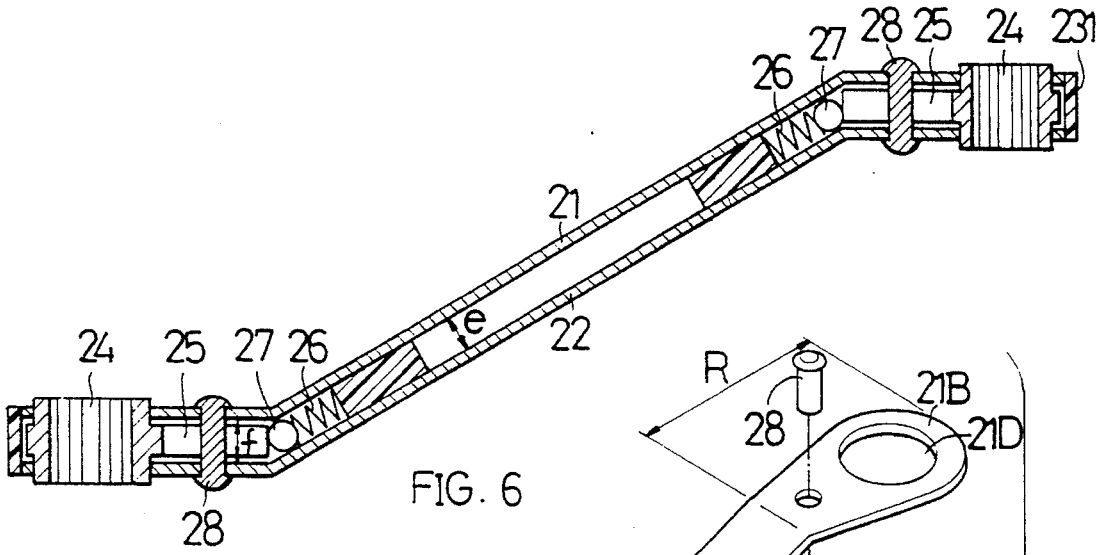
FIG. 6 is a sectional view of the first preferred embodiment of the improved ratchet wrench of the present invention.

Rivets 28 are used to assemble the above-described structural elements into the ratchet wrench of the invention shown in FIG. 6. The positioning bosses 233 on the protective flange 231 of the base 23 are used to urge against both the upper plate 21 and the lower plate 22 so that the ratchets 24 located in the bent portions are capable of pivot rotation therein. Additionally, the distance e between the upper plate 21 and the lower plate 22 at their flat and straight handle portions is smaller than the distance f between the first upper bent portion 21A and the first lower bent portion 22A as well as that between the second upper bent portion 21B and the second lower bent portion 22B.

Figure 7:
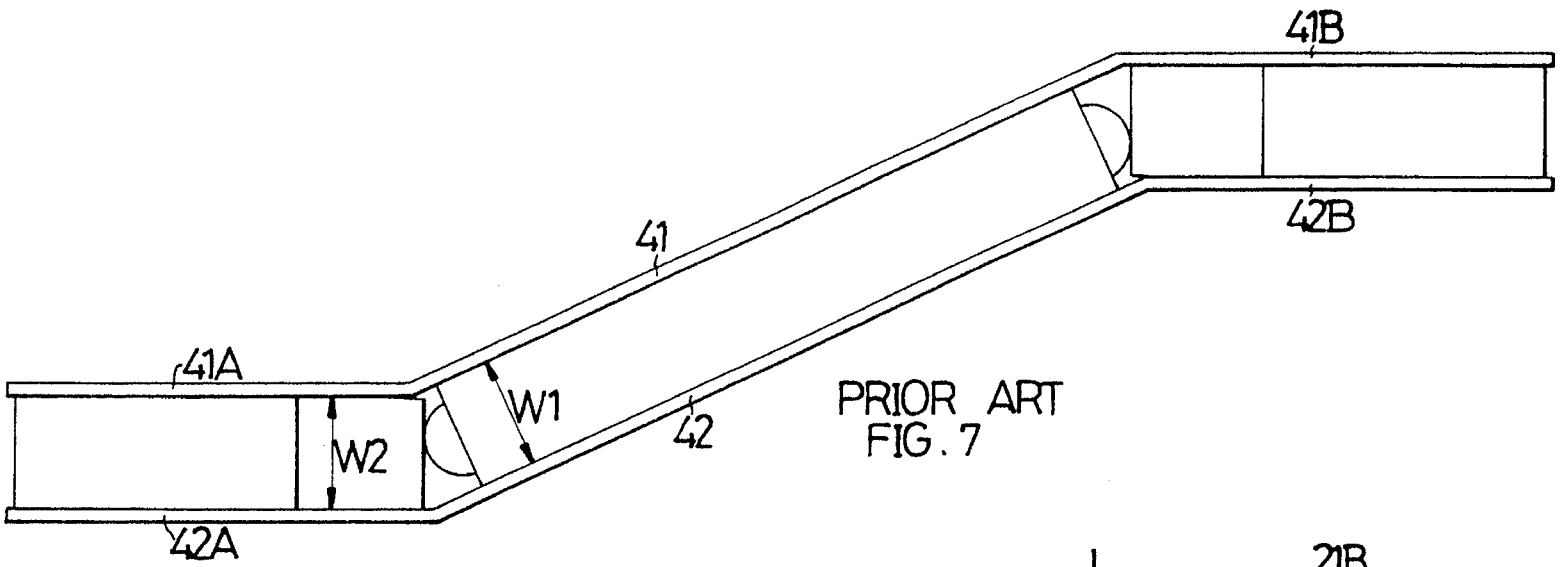
PRIOR ART FIG. 7
FIG. 7 is a side view of a conventional ratchet wrench with bent end portions, illustrating the relationship of the structural elements in assembly.

With reference to FIG. 7 which shows the conventional ratchet wrench with bent end portions, it should be noted that, in order that the distance W1 between the upper plate 41 and the lower plate 42 at their middle handle portions is equivalent to the distance W2 between the first upper bent portion 41A and the first lower bent portion 42A, the middle handle portions of the upper and lower plates 41 and 42 must be disposed in a parallel relationship, hence the second upper bent portion 41B of the upper plate 41 must extend forwardly to some extent so as to enable the end portion thereof to flush with the second lower bent portion 42B of the lower plate 42. For the same reason, the first lower bent portion 42A of the lower plate 42 must extend forwardly to some extent so that the end portion thereof may flush with that of the first upper bent portion 41A of the upper plate 41. The distance between the upper plate 41 and the lower plate 42 is kept uniform through out by means of the above arrangement.

Figure 8:
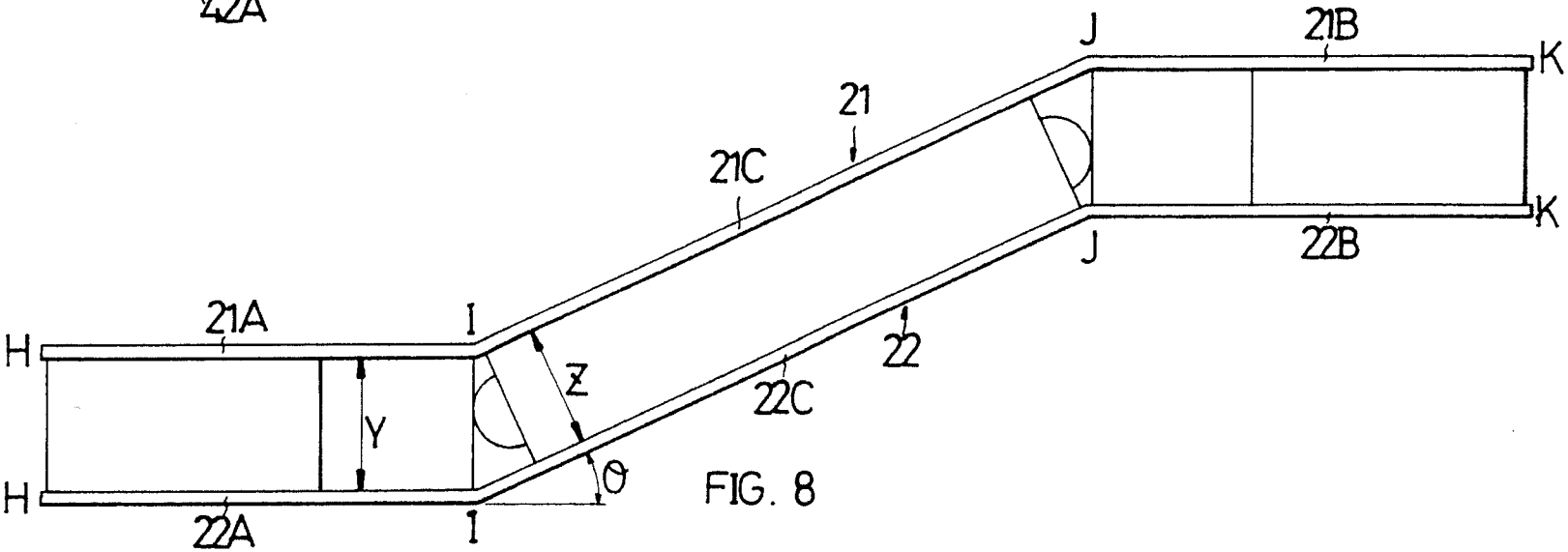
FIG. 8 is a side view of the first preferred embodiment of the improved ratchet wrench of the present invention, illustrating the relationship of the structural elements in assembly.

Reference is made to FIG. 8 which illustrates the assembly relationship of the ratchet wrench of the present invention. The upper plate 21 and the lower plate 22 which are of equal length are arranged with their ends H one on top of the other ill a parallel relationship. First points I are taken oil both plates 21 and 22 to obtain a suitable length of the first bent portions 21A and 22A. At this time, line H-H is parallel to line I-I. With I as their fixed points, both of the plates 21 and 22 are bent slightly upward through an angle θ. In this preferred embodiment, the angle θ is 25 degrees. Second points J are taken on the two plates 21 and 22 so as to define flat and straight middle portions 21C and 22C thereof, such that line I-I is parallel to line J-J. The remaining portions of the two plates 21 and 22 are then bent downwardly through the same angle θ so that they may form the second upper bent portion 21B and the second lower bent portion 22B with end points at K. In this way, the first bent portions 21A and 22A are parallel to the second bent portions 21B and 22B, while line K-K is parallel to line J-J, and line I-I is parallel to line H-H. Hence, there is formed a special trigonometric relationship at the bends between the bent portions and the middle handle portions of the plates. That is, when the bent portion bends through the angle θ (25 degrees), a trigonometric relationship as shown in FIG. 8 may be obtained, in which when the distance between the first upper bent portion 21A and the first lower bent portion 22A is Y (2 cm), the distance between the middle portions 21C and 22C is only Z (2×cos 25 degrees=1.8 cm). Therefore, it is found that the distance between the middle portions 21C and 22C of the two plates 21 and 22 is smaller than the distance between the upper bent portions 21A, 21B and the lower bent portions 22A, 22B.

Thus, in the improved ratchet wrench according to the present invention, there is a special relationship between the bent portions and middle portions of the upper and lower plates:

(the distance between the upper bent portions and the lower bent portions)×(cosine of angle of the bend)=(the distance between the upper middle portion and the lower middle portion)

Unlike the prior art in which the distance between the upper plate and the lower plate is maintained uniform through-out, the distance between the upper plate and the lower plate of the improved ratchet wrench according to the present invention is configured to be non-uniform, so that the shape and the length of the bent portions of the upper plate and the lower plate are identical, with the distance between the middle portions of the plates smaller than that between the upper bent portions and the lower bent portions. The comparatively thinner handle portion of the ratchet wrench of the invention will not, however, affect the rigidity and strength of the wrench since it is the transverse length of the handle, rather than the longitudinal thickness thereof, which bear forces exerted thereon; besides, a comparatively thinner handle will not affect the integrity of the wrench. Moreover, under the conditions of a greater resistance, the user will apply forces from one end of the wrench. Therefore, the arm of force of the wrench of the present invention is the same as that of the prior art and the overall effects of the present invention will not be affected.

In addition, since the improved ratchet wrench of the invention has identical upper and lower plates with identical bent portions, it is faster and less costly to manufacture.

Figure 9:
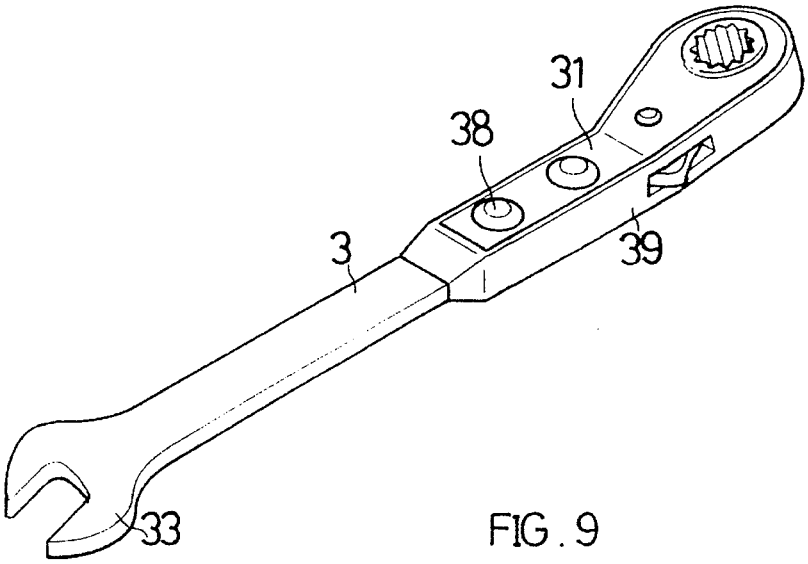
FIG. 9 is a perspective view of a second preferred embodiment of the improved ratchet wrench of the present invention.
Figure 10:
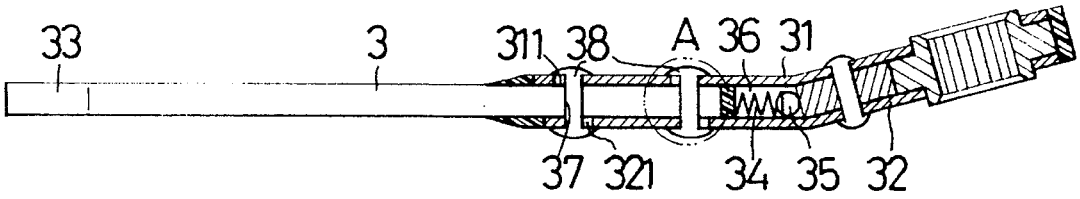
FIG. 10 is a sectional view of the second preferred embodiment of the improved ratchet wrench of the present invention.

With reference to FIGS. 9 and 10 which show a second preferred embodiment of the present invention, the improved ratchet wrench of the invention may be configured to be a combination wrench, comprising a base 3 disposed between an upper plate 31 and a lower plate 32, the base 3 having a jaw 33 at one end thereof and an elongated slot 36 for accommodating a spring 34 and a steel ball 35 at the other end thereof. A ratchet is accommodated between an upper bent portion of the upper plate 31 and a lower bent portion of the lower plate 32, and a round hole is provided in the bent portions for passage of a rivet therethrough. The upper plate 31 and the lower plate 32 are respectively provided with elongated round holes 311, 321 which match positioning holes 37 in the base 3 for passage of rivets 38 therethrough for securing the plates 31, 32 and the base 3. A protective flange 39 is further provided around the peripheries of the upper plate 31 and the lower plate 32 at a second half portion of the wrench with the ratchet. By means of the above arrangement, a combination wrench having a jaw and a ratchet may be achieved.

Figure 11:
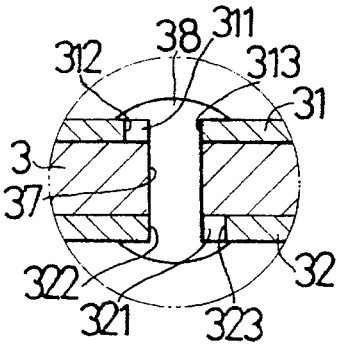
FIG. 11 is a partially enlarged view of A in FIG. 10.

In order to assemble the combination wrench ill the second preferred embodiment of the invention by rivets 38, the axes of the round holes in the upper and lower bent portions are aligned first. Then the elongated round holes 311 and 321 of the upper plate 31 and the lower plate 32 are arranged in a diagonal relationship, as shown in FIG. 11. A left end 312 and a right end 313 of the elongated round hole 311 of the upper plate 31 and a left end 322 and a right end 323 of the elongated round hole 321 of the lower plate are arranged to be parallel to a planar end of the bent portions. Hence, a vertical line of the right end 313 of the elongated round hole 311 of the upper plate 31 is located in the elongated round hole 32 1 of the lower plate 32. Relatively, a vertical line of the left end 322 of the elongated round hole 321 of the lower plate is located in the elongated round hole 311 of the upper plate 31. In this way, the distance between the right end 313 of the elongated round hole 311 of the upper plate and the left end 322 of the elongated round hole 321 of the lower plate 32 is equivalent to the diameter of the positioning hole 37 of the base 3, so that the rivet 38 may pass through the elongated round hole 311 of the upper plate 31, the positioning hole 37 of the base 3 into the elongated round hole 321 of the lower plate 32, with the left and right sides of the rivet 38 touching the right end 313 of the elongated round hole 311 of the upper plate 31 and the left end 322 of the elongated round hole 321 of the lower plate 32. The heads of the rivet 38 are then hammered flat to conceal the elongated round holes 311 and 321.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved ratchet wrench comprising:

a pair of ratchets;

a pair of identical plate members disposed in spaced parallel relationship, each of said pair of plate members having opposing ends thereof bent in opposite directions through a predetermined angle to form first and second bent portions and having a flat middle portion extending between said first and second bent portions, said flat middle portion being devoid of apertures, each of said first and second bent portions having a round hole formed therethrough for accommodating a respective one of said pair of said ratchets therein and an aperture formed adjacent said round hole, said first and second bent portions of one of said pair of plate members each having a respective length dimension identical to respective length dimensions of said other of said pair of plate members, said flat middle portions of said pair of plate members having an identical length dimension and being spaced by a dimension that is less than a dimension defining a distance between said first and second bent portions of said pair of plate members, said spacing dimension of said flat middle portion being defined by said dimension defining a distance between said first and second bent portions of said pair of plate members multiplied by a cosine of said predetermined angle;

a pair of trigger blocks disposed respectively between said first and second bent portions of said pair of plate members, each of said trigger blocks having a pair of spaced teeth formed on a front end portion thereof for engagement with a respective one of said pair of ratchets, each of said trigger blocks having a through opening formed therein and disposed in aligned relationship with a respective one of said apertures of each of said pair of plate members;

a base disposed between said flat middle portions of said pair of plate members, said base having a pair of elongated slots respectively formed in opposing ends thereof;

a continuous protective flange extending from opposing ends of said base and extending along opposing side edges of said base to circumscribe a perimeter edge of said pair of plate members, said protective flange having opposing edge portions disposed in contiguous relationship with respective outer surfaces of said pair of plate members, said protective flange having pairs of slotted openings formed therethrough adjacent said opposing ends of said base for passage therethrough of portions of said trigger blocks;

a pair of springs, each of said pair of springs being disposed in a respective one of said slots of said base;

a pair of baffle elements, each of said pair of baffle elements being biased by a respective one of said springs into contact with a rear end portion of a respective trigger block; and, means for securing said pair of plate members together defined by a single pair of rivets, each of said pair of rivets passing through said respective aperture in one of said first and second bent portions of both said pair of plate members and said through opening of a respective one of said pair of trigger blocks.

* * * * *